US007883184B2

(12) United States Patent
Sugahara

(10) Patent No.: US 7,883,184 B2
(45) Date of Patent: Feb. 8, 2011

(54) LIQUID TRANSPORTING APPARATUS

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1059 days.

(21) Appl. No.: 11/642,484

(22) Filed: Dec. 19, 2006

(65) Prior Publication Data

US 2007/0139479 A1 Jun. 21, 2007

(30) Foreign Application Priority Data

Dec. 19, 2005 (JP) ..... 2005-364284

(51) Int. Cl.
*B41J 2/06* (2006.01)

(52) U.S. Cl. ..... 347/55

(58) Field of Classification Search ..... 347/55, 347/54, 57–58, 65, 44, 20
See application file for complete search history.

(56) References Cited

U.S. PATENT DOCUMENTS

| | | | |
|---|---|---|---|
| 5,486,337 | A | 1/1996 | Ohkawa |
| 6,766,817 | B2 | 7/2004 | da Silva |
| 6,918,404 | B2 | 7/2005 | Dias da Silva |
| 7,066,586 | B2 | 6/2006 | da Silva |
| 2005/0219330 | A1 | 10/2005 | Sugahara |

FOREIGN PATENT DOCUMENTS

| | | |
|---|---|---|
| EP | 0 940 255 | 9/1999 |
| EP | 1 550 556 | 7/2005 |
| EP | 1 759 851 | 3/2007 |
| JP | 2005-288875 | 10/2005 |
| WO | WO 99/17083 | 4/1999 |
| WO | WO 02/07503 | 1/2002 |

OTHER PUBLICATIONS

An Investigation of Electrowetting-Based Microactuation, Journal of Vacuum Science & Technology (1990) Jul./Aug., No. 4, New York, US.

*Primary Examiner*—K. Feggins
(74) *Attorney, Agent, or Firm*—Frommer Lawrence & Haug LLP

(57) ABSTRACT

A liquid transporting apparatus includes a head which has individual channels. Individual electrodes and insulating layers which cover the individual electrodes respectively are provided on a channel-forming surface in which the individual channels are formed. When a predetermined electric potential is applied to the individual electrodes, an ink exists entirely in each of the individual channels, and a meniscus of the ink is formed in a discharge section corresponding to each of the individual channels. When a driver IC switches the electric potential of the individual electrodes to a ground electric potential, a part of the ink on a surface of the insulating layer moves toward the discharge section, and is discharged from the discharge section to outside of the head. Accordingly, there is provided a liquid transporting apparatus which is capable of stably discharging a liquid such as the ink in a predetermined amount.

18 Claims, 17 Drawing Sheets

LIQUID TRANSPORTING APPARATUS

CROSS REFERENCE TO RELATED APPLICATION

The present application claims priority from Japanese Patent Application No. 2005-364284, filed on Dec. 19, 2005, the disclosure of which is incorporated herein by reference in its entirety.

BACKGROUND OF THE INVENTION

1. Field of the Invention

The present invention relates to a liquid transporting apparatus which transports an electroconductive liquid.

2. Description of the Related Art

A recording head of an ink-jet type which jets an ink from nozzles onto a recording medium is generally used for a printer which records an image or the like by discharging (jetting) an ink onto a recording medium such as a recording paper. In such a recording head of the ink-jet type, however, the structure of an ink channel in the recording head and the structure of an actuator which generates a jetting pressure to be applied to the ink become special and complicated. Therefore, it has been difficult to minitualize the recording head by arranging a plurality of nozzles highly densely.

In view of this, the inventor of the present invention has proposed a new type of a recording head which uses, in a case that a surface of an electrode is covered by an insulating layer, a phenomenon (electrowetting phenomenon) in which a liquid repellent property (wetting angle) is changed on a surface of the insulating layer when an electric potential difference is changed between an electric potential of the surface of the insulating layer and an electric potential of the electrode (for example, see US Patent Application Publication No. US2005/219330 (corresponding to Japanese Patent Application Laid-open No. 2005-288875)). This recording head includes a plurality of individual channels formed as a plurality of grooves. Further, an individual electrode is provided to a channel-forming surface of each of the individual channels (bottom surface of each of the grooves); and in each of the individual channels, the surface of the individual electrode is covered by the insulating layer. Furthermore, since an ink in the head is in contact with a common electrode which is kept at a ground electric potential, an electric potential of the ink is always maintained at the ground electric potential. Moreover, at an upstream side of the individual channels, there is provided a pump which pressurizes the ink toward a discharge section formed in each of the individual channels at a front end (downstream end) thereof.

Here, an electric potential of the individual electrode is the ground electric potential, and when there is no electric potential difference between the ink and the individual electrode, then the liquid repellent property (wetting angle) on the surface of the insulating layer at a portion thereof sandwiched between the ink and the individual electrode is higher than a liquid repellent property on the surface of the insulating layer at an area thereof in which the insulating layer of a groove bottom surface is not provided or partially absent. Therefore, the ink cannot flow (cross) over or across the surface of the insulating layer to the discharge section, and thus the ink is not discharged from the discharge section. On the other hand, when the electric potential of the individual electrode is a predetermined electric potential which is different from the ground electric potential, there arises an electric potential difference between the ink and the individual electrode, and the liquid repellent property (wetting angle) is lowered on the surface of the insulating layer at the portion thereof sandwiched between the ink and the individual electrode (electrowetting phenomenon). As a results, the ink pressurized by the pump become movable to the discharge section while wetting the surface of the insulating layer, and the ink is discharged from the discharge section.

SUMMARY OF THE INVENTION

In the recording head described in US Patent Application Publication No. US2005/219330 as described above, during a period of time when a predetermined electric potential is applied to the individual electrode, the ink is continuously discharged from the discharge section. In other words, an amount of the ink discharged from the discharge section depends on a period of time (time duration) during which the predetermined electric potential is applied to the individual electrode. Therefore, the amount of ink discharged (ink-discharge amount) changes depending on a timing at which the electric potential is switched between the ground electric potential and the predetermined electric potential.

An object of the present invention is to provide a liquid transporting apparatus which is capable of stably discharging the ink in a predetermined (constant) amount.

According to a first aspect of the present invention, there is provided a liquid transporting apparatus which transports an electroconductive liquid, including:

a head including a channel having a channel-forming surface which is insulating and a discharge section from which the liquid is discharged, a working electrode which is arranged on the channel-forming surface, and an insulating layer which is provide on the channel-forming surface to cover the working electrode; and a power supply which supplies an operating voltage between the liquid and the working electrode;

wherein when the operating voltage is not less than a predetermined voltage, the liquid is disposed entirely on the channel-forming surface of the channel, a meniscus of the liquid is formed in the discharge section and the liquid is prevented from being discharged from the discharge section; and when the operating voltage is less than the predetermined voltage, a part of the liquid, which is on the surface of the insulating layer, is moved toward the discharge section and the part of the liquid is discharged from the discharge section.

According to the first aspect of the present invention, when the electric potential difference (operating voltage) between the liquid in the channel and the working electrode is not less than the predetermined voltage (demarcation electric potential difference) by applying, for example, a first electric potential to the working electrode by the power-supply (power-supply source, electric potential applying mechanism), then the liquid is disposed (exists) in the entire area of the channel including the surface of the insulating layer. At this time, the meniscus is formed in the discharge section, and the liquid is not discharged from the discharge section. In a case that, from this state, the operating voltage between the liquid in the liquid channel to decrease the working electrode to be less than the predetermined voltage by switching the electric potential of the working electrode, for example, from the first electric potential to a second electric potential with the power supply, then a part of the liquid, existing on the surface of the insulating layer is moved toward the discharge section, and the part of the liquid is pushed out (ejected) from the discharge section.

In this case, for example, when the operating voltage becomes less than the first voltage by the switch of the electric potential of the working electrode from the first electric potential to the second electric potential, the liquid is discharged from the discharge section in an amount which is nearly same as an amount in which the liquid moves from the surface of the insulating layer toward the discharge section. Therefore, the amount of the discharged liquid (liquid-discharge amount) is nearly constant (same) irrespective of the timing at which the electric potential is switched, thereby making it possible to stably discharge the ink in a predetermined amount.

In the liquid transporting apparatus of the present invention, when the operating voltage is less than the predetermined voltage, a liquid repellent property on the surface of the insulating layer may be more than a liquid repellent property on a first area, included in the channel-forming surface, in which the insulating layer is absent. In this case, the liquid repellent property on the insulating layer is more, than that on the first area, at an area (another area; non-coating area) which is different from the first area on the channel-forming surface. However, it is allowable that when, for example, a voltage greater than the predetermined voltage is applied between the liquid and the working electrode, the liquid repellent property on the insulating surface is lowered to be almost same as or lower (less) than the liquid repellent property on the channel-forming surface at another area different from the first area. Here, the term "almost same as or lower than" means that the liquid repellence property on the insulating layer is nearly same as that on the another area in the channel-forming area or the liquid repellent property on the insulating layer is lower than that the another area on the channel-forming area, and is a concept also including a case in which the liquid repellent property on the insulating layer is slightly higher (more) than that on the another area.

In the liquid transporting apparatus of the present invention, the power supply may supply selectively a first voltage not less than the predetermined voltage and a second voltage less than the predetermined voltage between the liquid and the working electrode. In this case, it is enough that the power supply is capable of supplying a predetermined combination of voltages, thereby simplifying the construction of the power supply.

The liquid transporting apparatus of the present invention may further include a pressure applying mechanism which applies, to the liquid in the channel, a pressure exerted toward the discharge section and being lower than a pressure by which the meniscus formed in the discharge section is destroyed. In this case, when the second electric-potential is applied to the liquid to discharge the liquid from the discharge section and then the first electric potential is applied again to the working electrode, the liquid moves rapidly onto the surface of the insulating layer by effect of the pressure applied by the pressure applying mechanism, thereby making it easy to discharge the liquid such as an ink, continuously from the same discharge section.

In the liquid transporting apparatus of the present invention, when the power supply supplies the second voltage between the liquid and the working electrode, an electric potential of the working electrode may be a ground electric potential. In this case, since the change amount in the voltage is great when the working voltage is switched between the first and second voltages, the change amount in the liquid repellent property (wetting angle), due to the voltage-switching, becomes great on the surface of the insulating layer. Accordingly, it is possible to perform a series of discharge operations assuredly.

In the liquid transporting apparatus of the present invention, the channel may include a plurality of liquid channels, and a common channel which commonly communicates with the plurality of liquid channels. In this case, it is possible to supply the liquid stably to the liquid channels via the common channel which has a substantial volume.

In the liquid transporting apparatus of the present invention, the common channel may have a common channel-forming surface which defines the common channel; a common electrode which is in a direct contact with the liquid in the common channel may be formed in the common channel-forming surface; and the power supply may maintain an electric potential of the common electrode at a predetermined electric potential. In this case, since the electric potential of the liquid in the liquid channel is maintained at the predetermined electric potential all the time, and the electric potential difference is stable between the liquid and the working electrode, thereby making it possible to perform the discharge operation of the liquid assuredly.

In the liquid transporting apparatus of the present invention, the predetermined electric potential may be a ground electric potential. In this case, when the first voltage is applied as the operating voltage, the electric potential difference is substantial between the liquid and the working electrode, thereby making it possible to perform a series of discharge operations assuredly.

In the liquid transporting apparatus of the present invention, each of the liquid channels may have a liquid channel-forming surface; and each of the liquid channels may be defined by a first liquid repellent area which has a liquid repellent property not less than a liquid repellent property of the liquid channel-forming surface. In this case, the liquid does not move crossing over or across the first liquid repellent area, between adjacent liquid channels. Further, since there is no need to provide a partition wall which partitions the liquid channels, it is possible to increase the arrangement density of the liquid channels (it is possible to arrange the liquid channels highly densely), thereby realizing the minitualization of the apparatus.

In the liquid transporting apparatus of the present invention, a second liquid repellent area having a liquid repellent property more than that of the channel-forming surface of the channel may be formed on a surface, of the head, which is continued to the discharge section and which faces outside the head. In this case, the liquid discharged from the discharge section is prevented, by the second liquid repellent area, from being adhered to the surface, of the head, which is continued to the discharge section. Therefore, the meniscus in the discharge section becomes stable.

In the liquid transporting apparatus of the present invention, a portion of the channel, which is continued to the discharge section, may be tapered toward the discharge section. In this case, when the ink discharged from the discharge section is made to adhere to some sort of medium, it is possible to limit (restrict) a portion, of the discharge section, which makes contact with the medium first, to be small. Therefore, it is possible to make the liquid adhere accurately to the medium at a desired position thereof.

In the liquid transporting apparatus of the present invention, a throttle, in which a channel area is narrowed locally, may be provided on the channel at a portion thereof on a side opposite to the discharge section with the working electrode being interposed between the throttle and the discharge section. In this case, a channel resistance is great in the throttle at the upstream side thereof (side opposite to the discharge section). Accordingly, when the second voltage is applied to the working electrode, it is possible to move the liquid in even larger amount from the surface of the insulating layer toward the discharge section, and to increase an amount of the liquid discharged in one discharge operation.

In the liquid transporting apparatus of the present invention, the working electrode and the insulating layer may be arranged in the channel-forming surface at an area thereof continued to the discharge section. In this case, it is possible to discharge the liquid from the discharge section assuredly.

In the liquid transporting apparatus of the present invention, the head may be provided with a cover member which covers the liquid in the channel to shield the liquid in the channel from an atmosphere outside the head. In this case, it is possible to suppress the drying of the liquid by the cover member.

In the liquid transporting apparatus of the present invention, each of the working electrode and the insulating layer may be formed to be zigzag shaped at a portion thereof on a side opposite to the discharge section. In this case, a border line (an outline) of each of the working electrode and the insulating layer at a side opposite to the discharge section is formed in a zigzag form in which two straight lines having mutually opposite direction of inclination (two types of straight lines which are inclined in mutually opposite directions) are arranged alternately in a width direction of the channel. Therefore, when the liquid repellent property on the surface of the insulating layer is lowered to be less than the liquid repellent property on the channel-forming surface at the another area thereof, the liquid moves rapidly from the upstream side (side opposite to the discharge section) onto the surface of the insulating layer.

In the liquid transporting apparatus of the present invention, the insulating layer may be formed of a fluororesin. In this case, it is possible to make the liquid repellent property on the insulating layer to be sufficiently higher when the operating voltage is less than the predetermined voltage, and to lower the liquid repellent property on the insulating layer sufficiently when the operating voltage is not less than the predetermined voltage.

In the liquid transporting apparatus of the present invention, an air hole, which communicates the liquid inside the channel with the atmosphere outside the head, may be formed in the cover member. In this case, it is possible to prevent the pressure inside the cover member from being depressurized accompanied with the transporting of the liquid, thereby transporting the liquid smoothly.

In the liquid transporting apparatus of the present invention, an inner surface of the cover member which defines the air hole may be coated by a fluororesin. In this case, it is possible to prevent the liquid from entering into the air hole due to a capillary effect.

The liquid transporting apparatus of the present invention may be a printer. In this case, since the number of mechanically driven components is small, it is possible to simplify the structure of the printer, and to provide a printer which is capable of discharging the liquid with high density.

DETAILED DESCRIPTION OF THE PREFERRED EMBODIMENTS

Next, an embodiment of the present invention will be explained below. This embodiment is exemplified by a printer, which performs recording by transporting an ink onto a recording paper, as a liquid transporting apparatus of the present invention. In the following explanation, frontward, rearward, left, and right directions in FIG. 1 are defined as frontward, rearward, left, and right sides, respectively.

Figure 1:
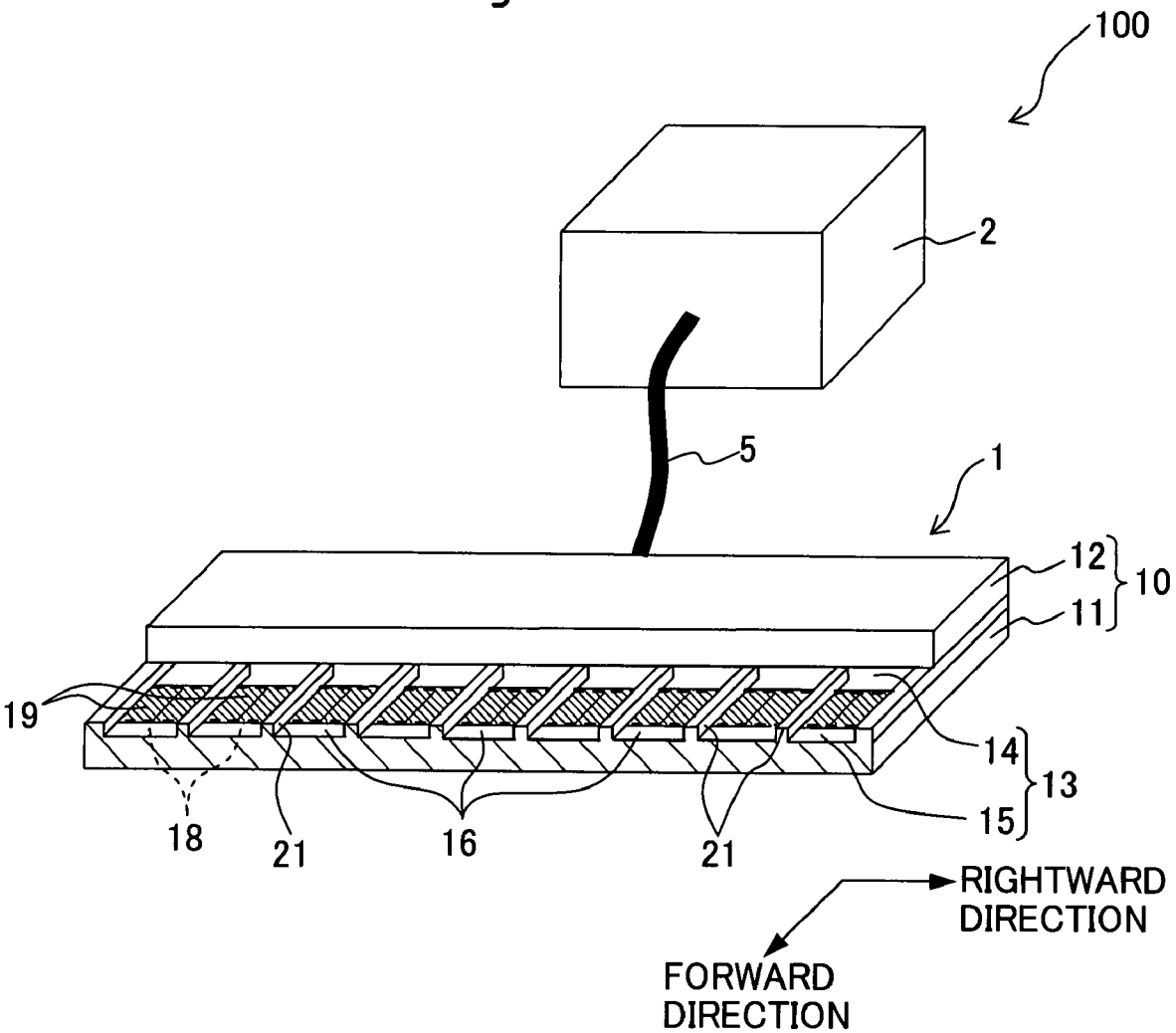
FIG. 1 is a schematic structural view of a printer according to an embodiment of the present invention.

As shown in FIG. 1, a printer 100 in this embodiment includes a recording head 1 (see FIGS. 4 to 7) which records an image and/or the like by discharging (jetting) an ink onto a recording paper P, an ink tank 2 which is connected to the recording head 1 via a tube 5, and a controller 3 (see FIG. 3) which controls transportation (feeding) of the recording paper P by an unillustrated paper feeding mechanism and controls discharge of the ink (ink-discharge) by the recording head 1. The printer 100 records a desired image on the recording paper P by discharging ink, from a plurality of discharge sections 16 of the recording head 1, toward the recording paper P which is transported in front of the discharge sections 16 of the recording head 1. The ink used in the recording head 1 of this embodiment is an electroconductive ink such as an aqueous dye ink which is mainly composed of water and to which a dye and a solvent are added, or an aqueous pigment ink which is mainly composed of water and to which a pigment and a solvent are added.

Next, the recording head 1 will be explained. As shown in FIG. 1, the recording head includes a head body 10. The head body 10 includes a substrate 11 which has a form of a flat plate, has a rectangular shape and is longer in a left and right direction in a plan view; and a box member 12 which is arranged on the substrate 11 at a rear-side portion thereof to partially cover an upper surface of the substrate 11.

An ink channel 13 which is extended along a horizontal plane, and through which the electroconductive ink flows is formed in the head body 10. The ink channel 13 includes a common channel 14 and a plurality of individual channels 15 (liquid channels). The common channel 14 is formed by the upper surface of the substrate 11 and the box member 12, and is extended in the left and right direction. The individual channels 15 are formed on or in the upper surface of the substrate 11, at a front-end side portion of the upper surface, and are branched from the common channel 13 and extend in a frontward direction. Discharge sections 16 are provided on the individual channels 15, respectively, each at front end thereof. As shown in FIG. 1, the discharge sections 16 are arranged in a row in the left and right direction on a front end surface of the substrate 11. The head body 10 is made of a glass material, a ceramics material such as alumina or zirconia, a synthetic resin material such as polyimide, silicon having an oxide film ($SiO_2$) formed on a surface thereof, or the like; and at least the upper surface of the substrate 11 (channel-forming surface on which the common channel 14 and individual channels 15 are formed) is insulating.

Figure 2:
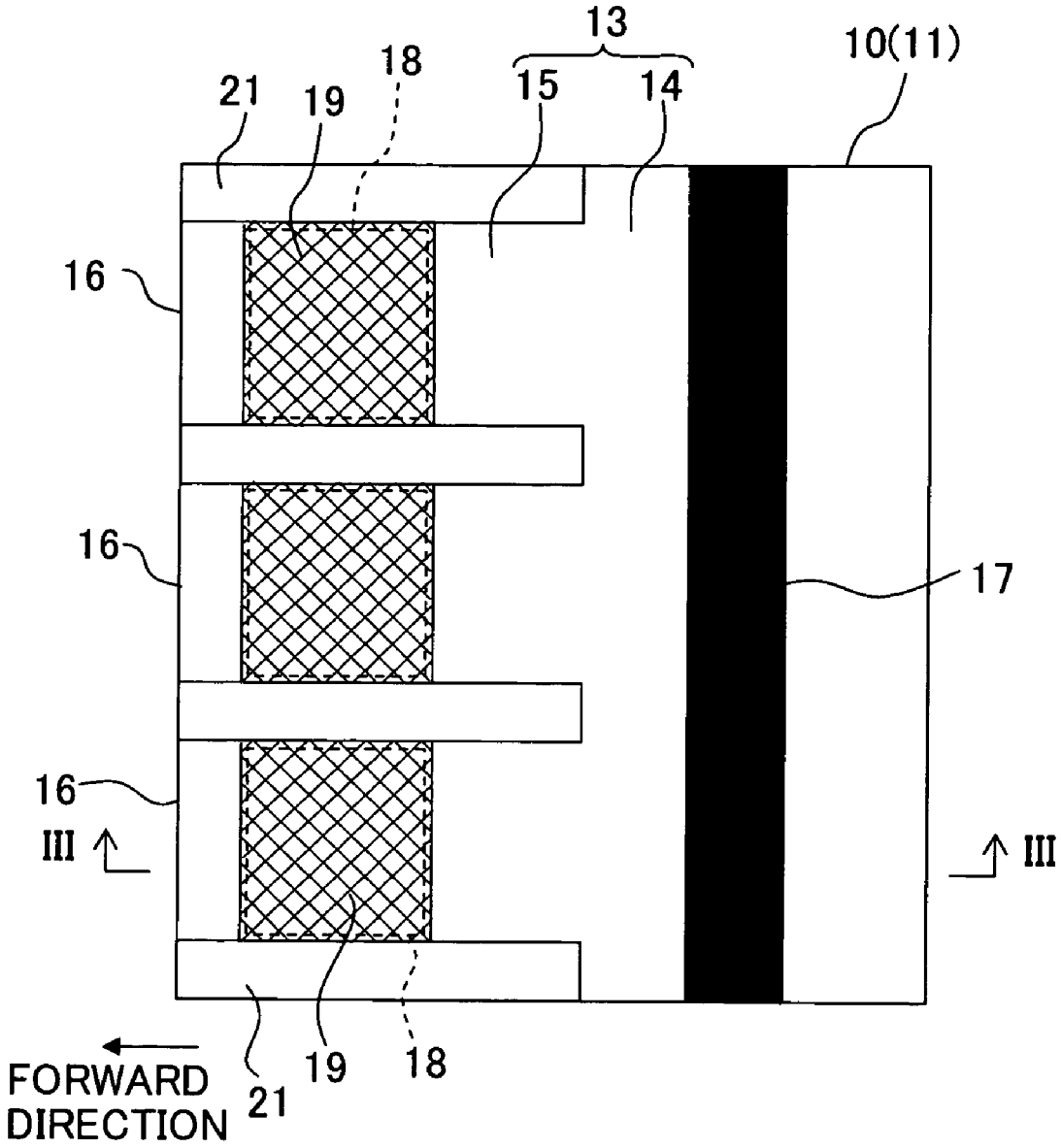
FIG. 2 is a horizontal cross-sectional view of a recording head.
Figure 3:
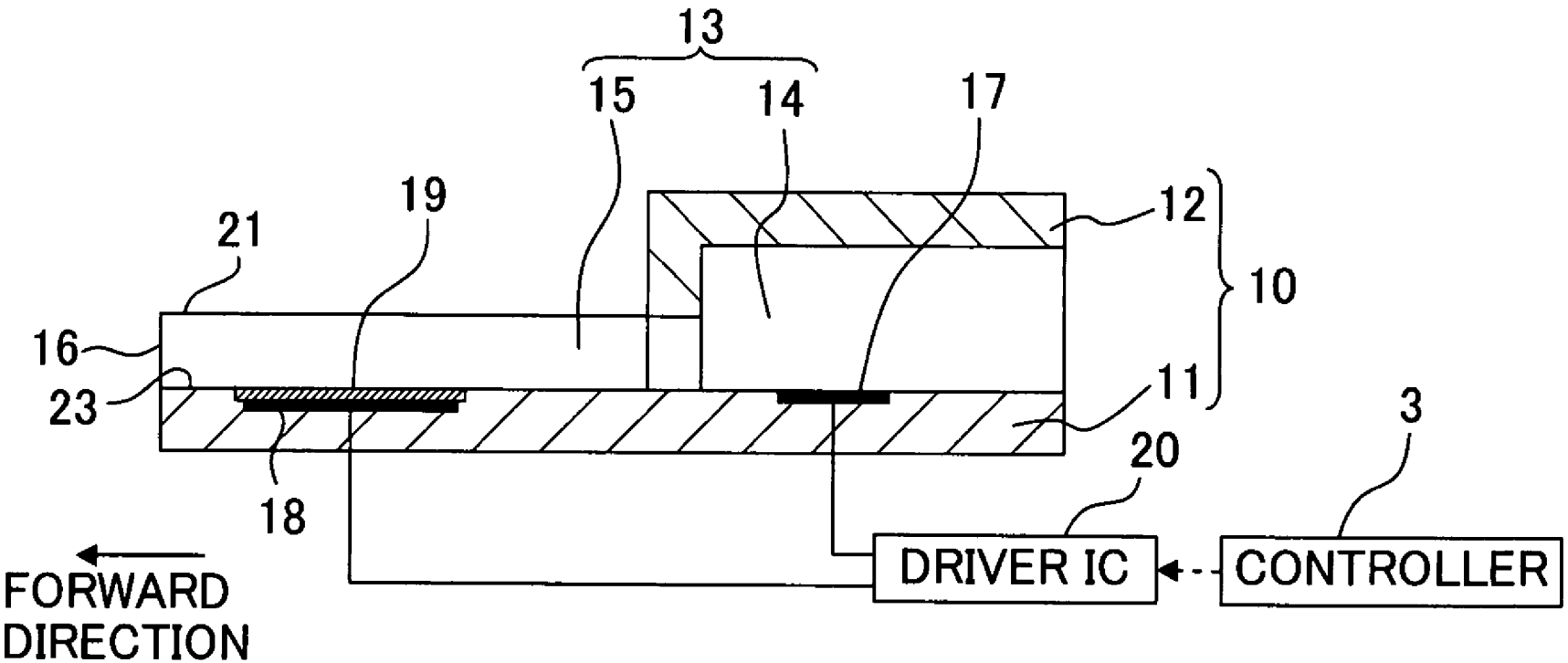
FIG. 3 is a cross-sectional view taken along a line III-III shown in FIG. 2.

As shown in FIGS. 2 and 3, the common channel 14 is arranged at a rear side of the individual channels 15, and communicates with all the individual channels 15. Further, since the common channel 14 is connected to the ink tank 2 (see FIG. 1), the ink stored in the ink tank 2 is supplied stably to the individual channels 15 via the common channel 14 which has a substantial volume (channel cross-sectional area). In this embodiment, a height of an ink level inside the ink tank 2 is almost same as a height of an ink level inside the common channel 14, and head pressure of the ink tank 2 hardly acts to the ink in the ink channel 13. In other words, pressure exerted toward the discharge sections 16 does not act (is not exerted) to the ink. Furthermore, a common electrode 17, which has a rectangular shape in a plan view, and which is extended over almost an entire area of the substrate 11 along a direction in which the substrate 11 is extended (left and right direction), is formed in the substrate 11 in the upper surface of the substrate 11 forming the common channel 14 (common channel-forming surface), at a rear-side portion of the upper surface. Moreover, as shown in FIG. 3, the common electrode 17 is electrically connected to a driver IC 20 which is a driving circuit, and is kept at a ground electric potential via this driver IC 20. As shown in FIGS. 4 to 7, since the electroconductive ink in the common channel 14 is in contact with this common electrode 17, the electric potential of the ink is always maintained at the ground electric potential (third electric potential).

As shown in FIGS. 2 and 3, the individual channels (liquid channels) 15 are constructed such that adjacent individual channels 15 are mutually partitioned by partition walls 21 formed to project on the upper surface of the substrate 11. Further, the individual channels 15 are open in the upward direction, and also open in the frontward direction via the discharge sections 16 disposed at the front ends thereof respectively. A plurality of individual electrodes 18 (working electrodes) having a substantially rectangular shape in a plan view is formed on the upper surface of the substrate 11, which is the channel-forming surface (bottom surface 23, liquid channel-forming surface) of these individual channels 15, at a front-side portion of the upper surface. Each of the individual electrodes 18 is formed over one of the individual channels 15 so as to substantially span across (cover) the entire area of the individual electrode 18, in a width direction of one of the individual channels 15. Furthermore, as shown in FIG. 3, the individual electrodes 18 are electrically connected to the driver IC 20 which will be explained later, and a predetermined electric potential is applied to the individual electrodes 18 from the driver IC 20.

The common electrode 17 and the individual electrodes 18 as explained above are formed in or on the upper surface of the substrate 11 by a method such as a screen printing, a sputtering method, a vapor deposition method, or the like.

Insulating layers 19 made of a material such as a fluororesin are arranged on the upper surface (bottom surface 23), of the substrate 11, each at an area thereof in which one of the individual electrodes 18 is arranged, and covers entirely a surface of one of the individual electrodes 18. As shown in FIG. 2, the individual electrodes 18 and the insulating layers 19 are arranged at positions slightly away from the discharge sections 16, respectively, in a rearward direction (toward the rear-side portion of the substrate 11). Further, each of the insulating layers 19 is formed by coating a material such as a fluororesin on the surface of one of the individual electrodes 18 by a method such as a spin coating, a chemical vapor deposition, or the like. A liquid repellent property (wetting angle) on a surface of the insulating layer 19 changes according to an electric potential difference between the ink located above or over the insulating layer 19 and the individual electrode 18 located below or under the insulating layer 19 (electrowetting phenomenon).

When the electric potential difference between the ink and the individual electrode 18 is not less than a predetermined electric potential difference ΔV (demarcation electric potential difference, first electric potential difference, predetermined voltage), then the liquid repellent property on the surface of the insulating layer 19 is almost same as or lower than a liquid repellent property on an area (non-coating area, first area) which is included in the bottom surface 23 as the channel-forming surface of the individual channel 15, and in which the insulating layer 19 is not formed. On the other hand, when the electric potential difference between the ink and the individual electrode 18 is less than the demarcation electric potential difference ΔV, then the liquid repellent property on the surface of the insulating layer 19 is more than the liquid repellent property on the non-coating area of the bottom surface 23. This will be explained in further detail in the following explanation of the driver IC 20.

Next, the driver IC 20 (electric potential applying mechanism, power supply) will be explained below. As shown in FIG. 3, the driver IC 20 is connected to the common electrode 17 and the individual electrodes 18. The driver IC 20 is capable of maintaining (keeping) the common electrode 17, which is in contact with the ink, at the ground electric potential (third electric potential) all the time, and of applying selectively one of a predetermined electric potential V (first electric potential) and the ground electric potential (second electric potential) to the individual electrodes 18 positioned below the insulating layers 19 respectively.

Figure 4:
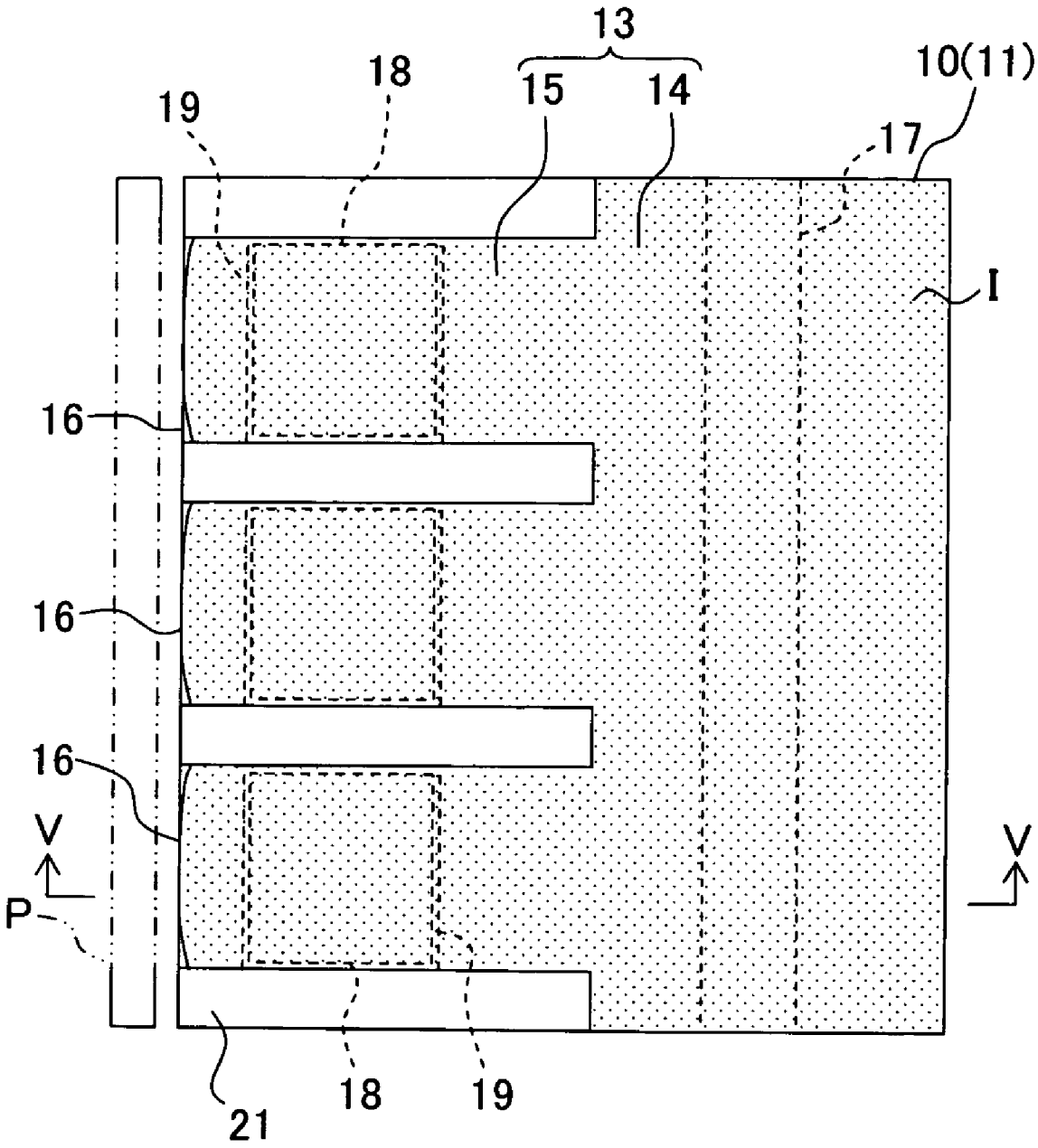
FIG. 4 is a horizontal cross-sectional view of the recording head in a state the an ink is not discharged.
Figure 5:
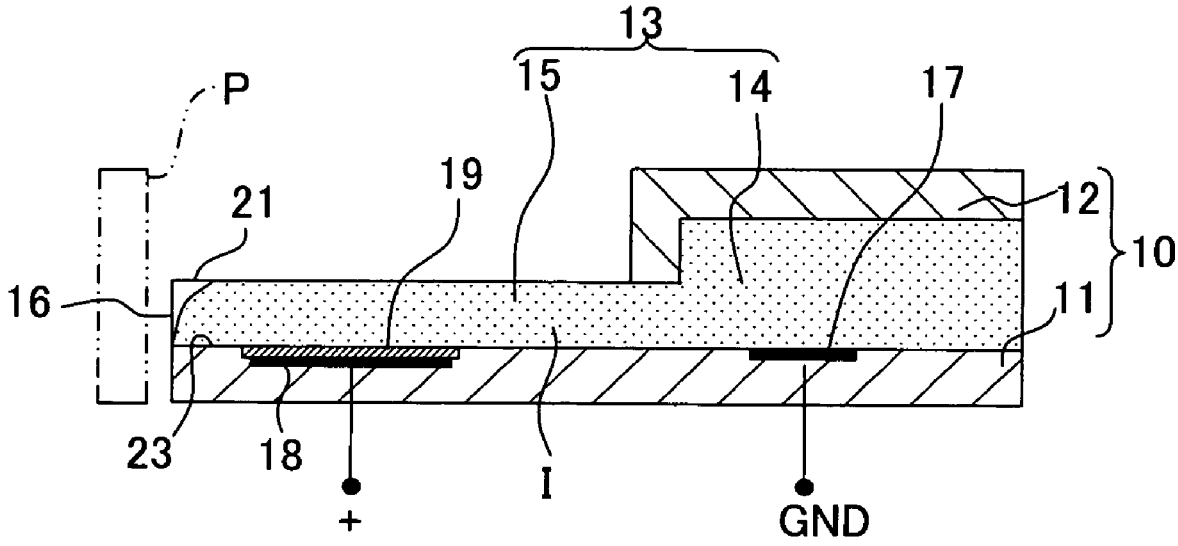
FIG. 5 is cross-sectional view taken along a line V-V shown in FIG. 4.
Figure 6:
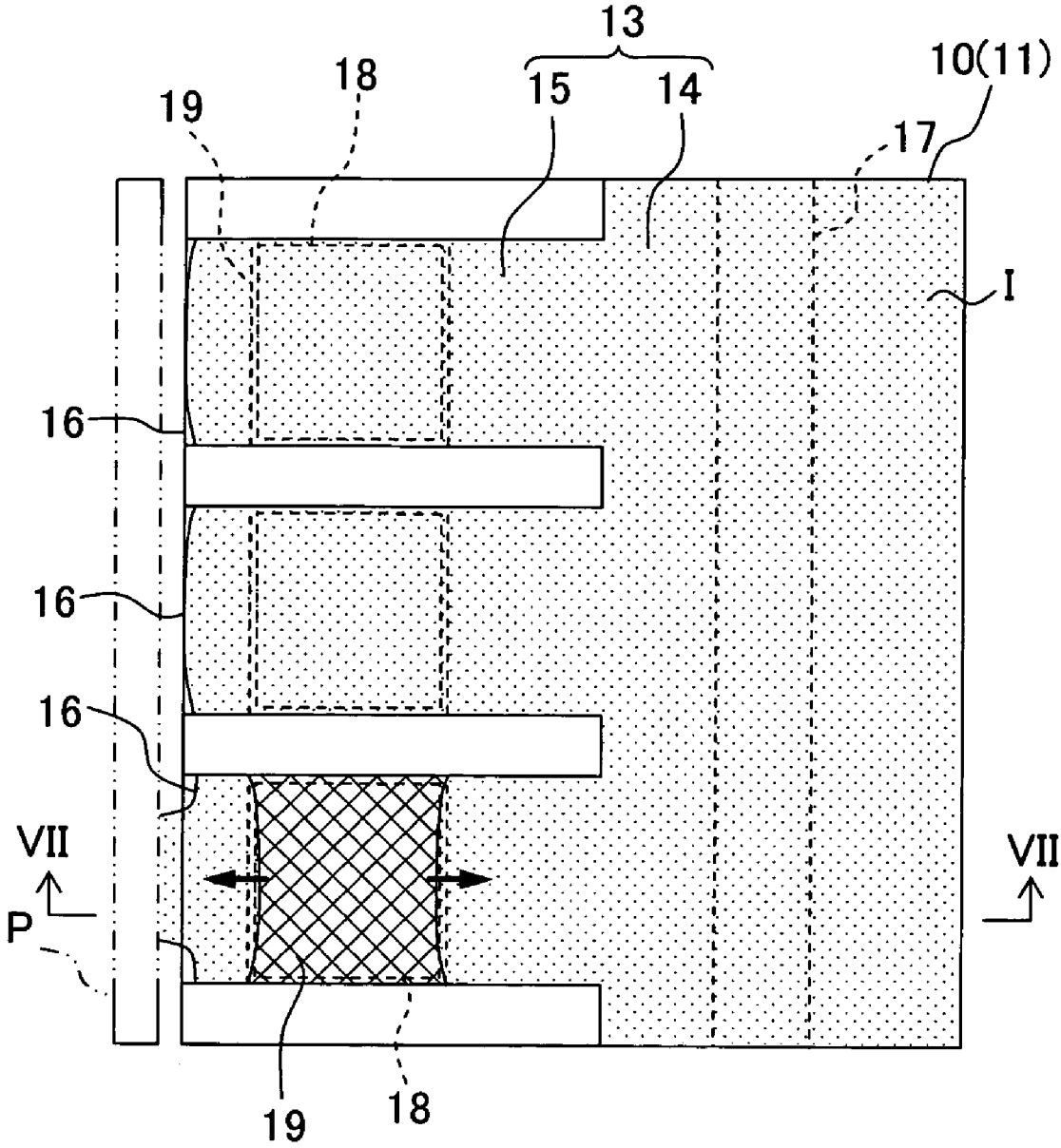
FIG. 6 is a horizontal cross-sectional view of the recording head in a state that the ink is discharged.
Figure 7:
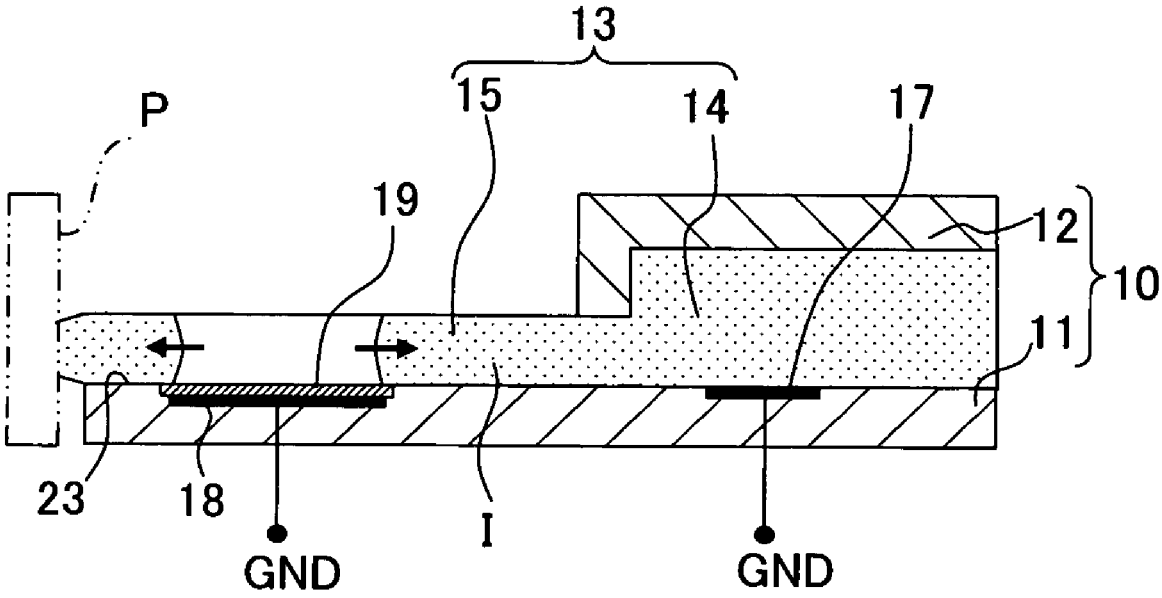
FIG. 7 is a cross-sectional view taken along a line VII-VII shown in FIG. 6.

An action of the recording head 1, when the driver IC 20 switches the electric potential of the individual electrode 18 between the first electric potential V and the ground electric potential, will be explained with reference to FIGS. 4 to 7. In FIGS. 5 and 7, a symbol "+" indicates that the electric potential of the individual electrode 18 is the first electric potential V, whereas a symbol "GND" indicates that the electric potential of the individual electrode 18 or the common electrode 17 is the ground electric potential.

The first electric potential V is set such that a difference between the first electric potential V and the electric potential of the ink is not less than the demarcation electric potential difference ΔV described above. In other words, when the first electric potential V is applied by the driver IC 20 to a certain individual electrode or electrodes 18 in a certain individual channel 15 among the individual channels 15, the electric potential difference between the ink at the ground electric potential and the individual electrode 18 becomes not less than the demarcation electric potential difference ΔV. At this time, the liquid repellent property on the surface of the insulating layer 19 is almost same as or lower than the liquid repellent property on the non-coating area, of the bottom surface 23 as the channel-forming surface of the individual channel 15, in which the insulating layer 19 is not formed. In this case, as shown in FIGS. 4 and 5, an ink I exists (is disposed) on the entire area of the bottom surface 23 including the surface (coating area) of each of the insulating layers 19. A meniscus of the ink I is formed in the discharge sections 16 disposed at the front end of the individual channel 15, and a pressure directed toward the discharge sections 16, such as a head pressure of the ink tank 2, is not applied to (exerted on) the ink in the individual channels 15. Consequently, as long as the electric potential of the individual electrodes 18 is maintained at the first electric potential V, the meniscus formed at the discharge sections 16 is not destroyed and the ink I is not discharged from the discharge sections 16.

When the driver IC 20 switches from a state in which the first electric potential V is applied to a certain individual electrode 18, to a state in which the ground electric potential is applied to the certain individual electrode 18, the electric potential difference between the ink and the certain individual electrode 18 becomes zero, and becomes less than the demarcation electric potential difference ΔV (second voltage). Therefore, the liquid repellent property on the surface of an insulating layer 19 corresponding to the certain individual electrode 18 becomes more than the liquid repellent property on the non-coating area of the bottom surface 23. In this case, as shown in FIGS. 6 and 7, the ink I, which existed on the surface of the insulating layer 19, is divided into two parts or portions to move toward the upstream side and the downstream side, respectively, of the individual channel 15. When a part of the ink moves to the downstream side (toward the discharge section 16) of the individual channel 15, the part, of ink I which existed between the insulating layer 19 and the discharge section 16, is pushed out (ejected) from the discharge section 16 to the outside of the recording head 1, and is discharged toward the recording paper P.

Next, the controller 3 will be explained below. The controller 3 includes a central processing unit (CPU), a Read Only Memory (ROM) in which various computer programs and various data for controlling the printer 100 are stored, and a Random Access Memory (RAM) which temporarily stores data to be processed in the CPU. The controller 3 controls the driver IC 20 to discharge the ink from a predetermined discharge section 16, based on a printing data which is inputted by an external input device such as a PC (personal computer). In addition, the controller 3 controls the paper feeding mechanism (omitted in the diagram) which feeds the recording paper P. Thus, the controller 3 controls various operations of the printer 100.

Next, a series of ink discharge operations by the recording head 1 will be explained below. Firstly, when the printing data is not inputted to the controller 3 from the external input device such as PC, then as shown in FIGS. 4 and 5, the first electric potential V is applied by the driver IC 20 to all the individual electrodes 18 and the electric potential difference between the ink and the individual electrodes 18 is not less than the demarcation electric potential difference ΔV. At this time, the liquid repellent property on the surface of each of the insulating layers 19 (coating area of the bottom surface) is almost same as or lower than the liquid repellent property on the non-coating area of the bottom surface 23. Therefore, the ink exists over the entire area of the bottom surface 23 including the surfaces of the insulating layers 19. In this state, the meniscus of the ink is not destroyed and the ink is not discharged from the discharge sections 16. This state is referred to as a stand-by state.

In the stand-by state, when the printing data is inputted to the controller 3 from the external input device, the controller 3 controls the driver IC 20 to discharge the ink from a discharge section 16 of a predetermined individual channel 15. As shown in FIGS. 6 and 7, the driver IC 20 switches the electric potential of an individual electrode 18, corresponding to the individual channel 15 communicating with the discharge section 16 from which the ink is to be discharged, from the first electric potential V to the ground electric potential. At this time, the electric potential difference between the ink and the individual electrode 18 becomes less than the demarcation electric potential difference (becomes almost zero). At this time, since the liquid repellent property on the surface of the insulating layer 19 becomes more than the liquid repellent property on the non-coating area of the bottom surface 23, the ink cannot exist on the surface of the insulating layer 19. As shown by arrows in FIGS. 6 and 7, the ink is divided into two parts or portions to move from the surface of the insulating layer 19 toward the upstream side (rear side: toward the common channel 14) and the downstream side (front side: toward the discharge section 16), respectively. At this time, a part, of the ink between the discharge section 16 and the insulating layer 19, is pushed forward to destroy the meniscus formed at the discharge section 16, and the ink is discharged in a predetermined amount from the discharge section 16. Here, an ink-discharge amount of the ink discharged from the discharge section 16 is almost same as an amount of the part of the ink which moves from the surface of the insulating layer 19 toward the discharge section 16 when the electric potential of the individual electrode 18 is switched from the first electric potential V to the ground electric potential.

Further, after the ink has been discharged in the predetermined amount from the discharge section 16, the meniscus is formed again at the discharge section 16. When the meniscus of the ink is formed, the ink is not discharged any more. After this, when the driver IC 20 switches the electric potential of the individual electrode 18 from the ground electric potential to the first electric potential V, the liquid repellent property on the surface of the insulating layer 19 becomes almost same as or lower than the liquid repellent property on the non-coating area of the bottom surface 23, and the ink flows from the upstream side of the individual channel 15 to the surface of the insulating layer 19. In other words, the ink is returned to a state (stand-by state) in which the ink exists over the entire surface of the individual channel 15 including the surfaces of the insulating layers 19.

According to the printer 100 of this embodiment, the following effect is achieved. The ink-discharge amount of the ink discharged from the discharge section 16 is same as the amount of the part of the ink which moves from the surface of the insulating layer 19 toward the discharge section 16 when the electric potential of the individual electrode 18 is switched from the first electric potential V to the ground electric potential. Consequently, since the ink-discharge amount becomes almost constant (fixed) irrespective of a timing at which the electric potential of the individual electrode 18 is switched, thereby making it possible to discharge the ink stably in a predetermined amount.

The electric potential (second electric potential) applied to the individual electrode 18 when discharging the ink is the ground electric potential. Therefore, it is possible to obtain a substantial change amount by which the electric potential difference is changed between the ink and the individual electrode 18 before and after switching the electric potential of the individual electrode. Accordingly, it is possible to increase the change amount in the liquid repellent property (wetting angle) on the surface of the insulating layer 19, and to perform the series of discharge operations assuredly.

The common electrode 17 is formed in the substrate 11 on the upper surface, which is the channel-forming surface of the common channel 14, at the rear-side portion of the upper surface. In the common channel 14, since the ink is in contact with the common electrode 17 all the time, the electric potential of the ink is stable, and the ink is discharged assuredly. The electric potential of the common electrode 17 (third electric potential) is the ground electric potential. Therefore, when the first electric potential V is applied to the individual electrode 18, the electric potential difference between the ink and the individual electrode 18 is substantial. Accordingly, it is possible to perform the series of discharge operations assuredly.

Next, an explanation will be given about modifications in each of which various changes are made to the embodiment. Parts or components of the modifications, which are same in construction as those in the embodiment, will be assigned with same reference numerals and any explanation therefor will be omitted as appropriate.

First Modification

Figure 8:
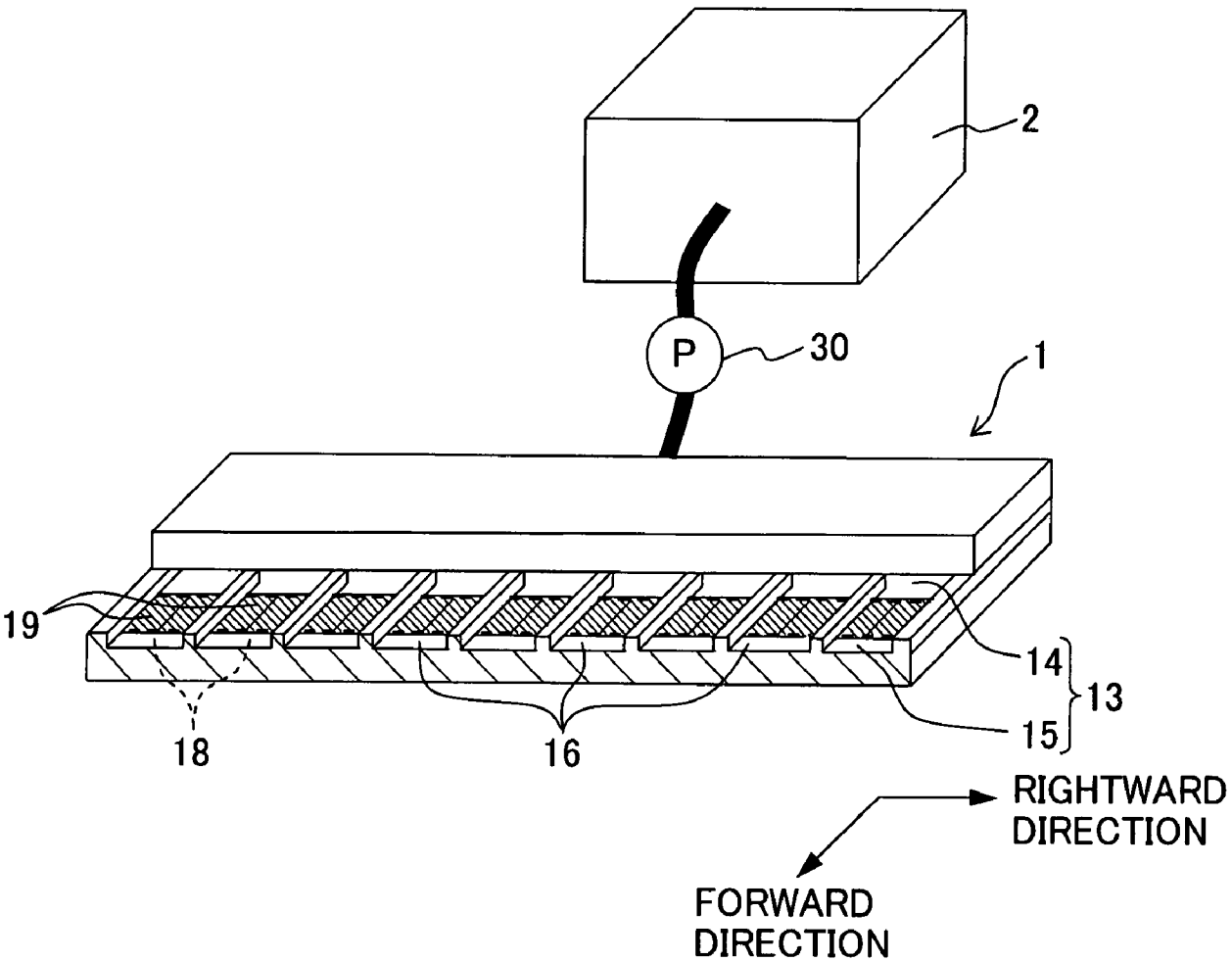
FIG. 8 is a diagram showing a schematic structure of an example of a printer according to a first modification.

A pressure may be applied all the time to the ink in the ink channel 13. For example, it is allowable that, by arranging ink tank 2 such that an ink level in the ink tank 2 is always arranged at a position higher than an ink level in the ink channel 13 of the recording head 1, the head pressure of the ink tank 2 acts all the time to the ink in the ink channel 13, and a pressure directed to the discharge sections 16 is applied to the ink. Alternatively, as shown in FIG. 8, a pump 30 which applies, to the ink, the pressure directed to the discharge sections 16 may be provided between the ink tank 2 and the recording head 1. Still alternatively, it is allowable that, by inclining the ink channel 13 downwardly with respect to a horizontal plane such that the ink channel 13 is inclined progressively toward the discharge sections 16 (frontward direction), a pressure directed toward the discharge sections 16 is applied to the ink by a gravitational force acting on the ink.

In this case, however, the pressure applied to the ink is set to be lower than a pressure with which the meniscus is destroyed, so as to prevent the ink from being leaking out due to the destruction of the meniscus in the discharge section 16, when the first electric potential V is applied to the individual electrode 18. The pressure to be applied to the ink is set appropriately by adjusting, for example, a height of the position at which the ink tank is arranged, a discharge pressure of the pump, a degree of inclination (angle of inclination) of the ink channel 13, or the like.

At this time, when the ink is discharged from the discharge section 16 upon switching the electric potential of the individual electrode 18 from the first electric potential V to the ground electric potential and then the electric potential of the individual electrode 18 is switched once again to the first electric potential V, the ink moves rapidly to the surface of the insulating layer 19 by the action of the pressure applied by the pressure applying mechanism. Consequently, it becomes easy to discharge the ink continuously from one (same) discharge section 16.

Alternatively, it is allowable that a pressure directed toward a side opposite to the discharge sections 16 (directed in the rearward direction) is applied to the ink in the ink channel 13 by, for example, making the ink level in the ink tank 2 to be lower than the ink level in the ink channel 13. In this case, in a state in which the first electric potential V is applied to the individual electrodes 18 (in other words, a state in which the ink is not discharged from the discharge sections), it is possible to prevent the meniscus of the ink formed in the discharge sections 16 from being moving forward, due to a impurity or the like adhered around the discharge sections 16, to dirty or stain the recording paper P.

In the first modification, the ink tank 2 which exerts a positive pressure or a negative pressure to the ink, the pump 30 which pressurizes or depressurizes the ink, and the inclined ink channel 13 correspond to the pressure applying mechanism in the invention of this patent application. However, the pressure applying mechanism of the present invention is not limited to the construction including the ink tank 2, the pump 30 and the inclined ink channel.

Specifically, for example, when dimension of the discharge sections 16 is 70 μm×20 μm, it is preferable that a pressure due to a water head difference in a range of −50 mm to +50 mm (about −500 Pa to +500 Pa) is applied to the ink in the ink channel 13.

Second Modification

Figure 9:
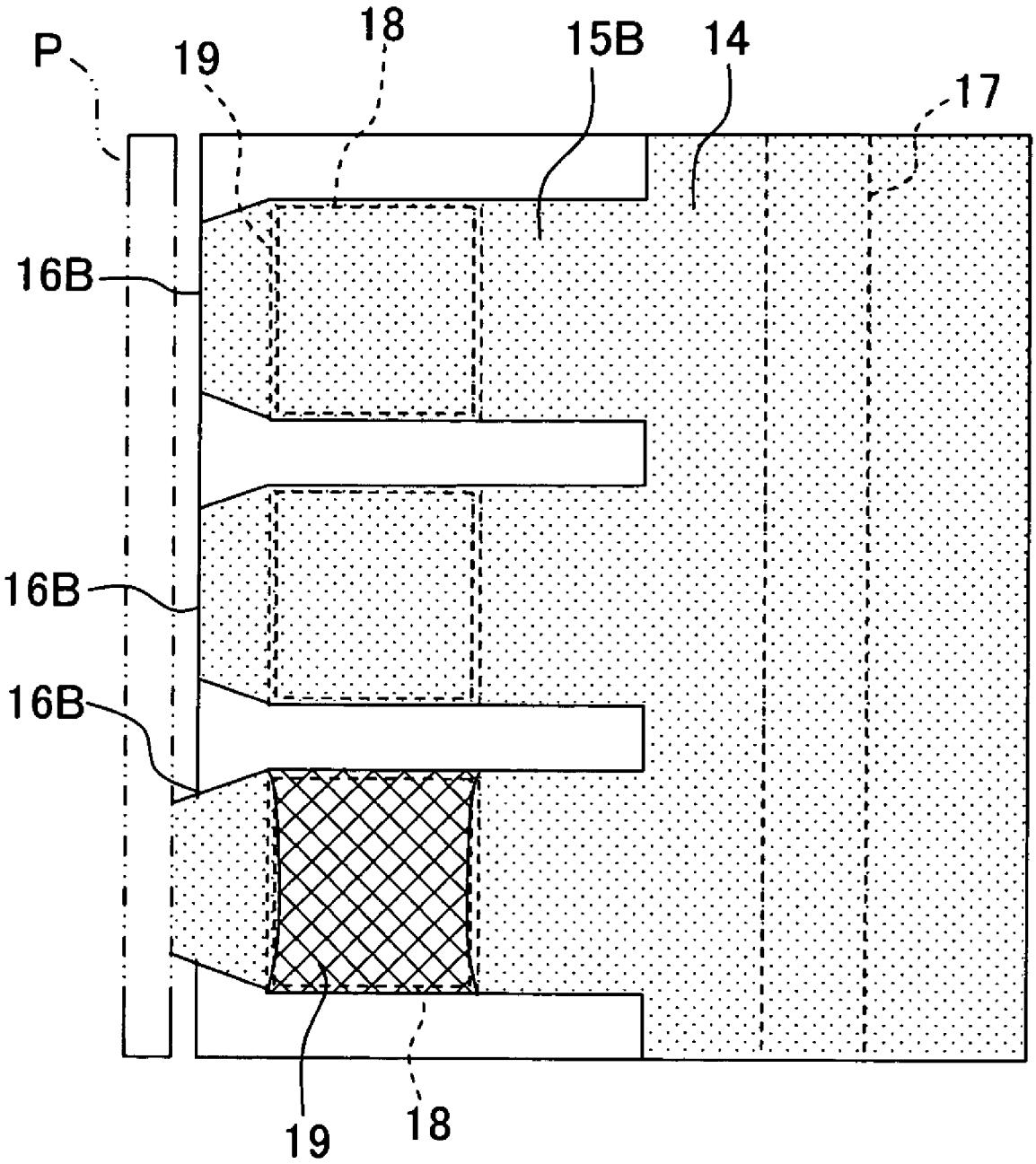
FIG. 9 is a horizontal cross-sectional view of a recording head of a second modification.

As shown in FIG. 9, front ends of individual channels 15B communicating with discharge sections 16B respectively may be tapered so that a channel area thereof is narrowed progressively toward the discharge section 16B. In this case, since it is possible to restrict a portion, of the ink, which makes a contact with the recording paper P first to be small, the ink discharged from the discharge section 16B lands on the recording paper P accurately at a desired position.

Third Modification

Figure 10:
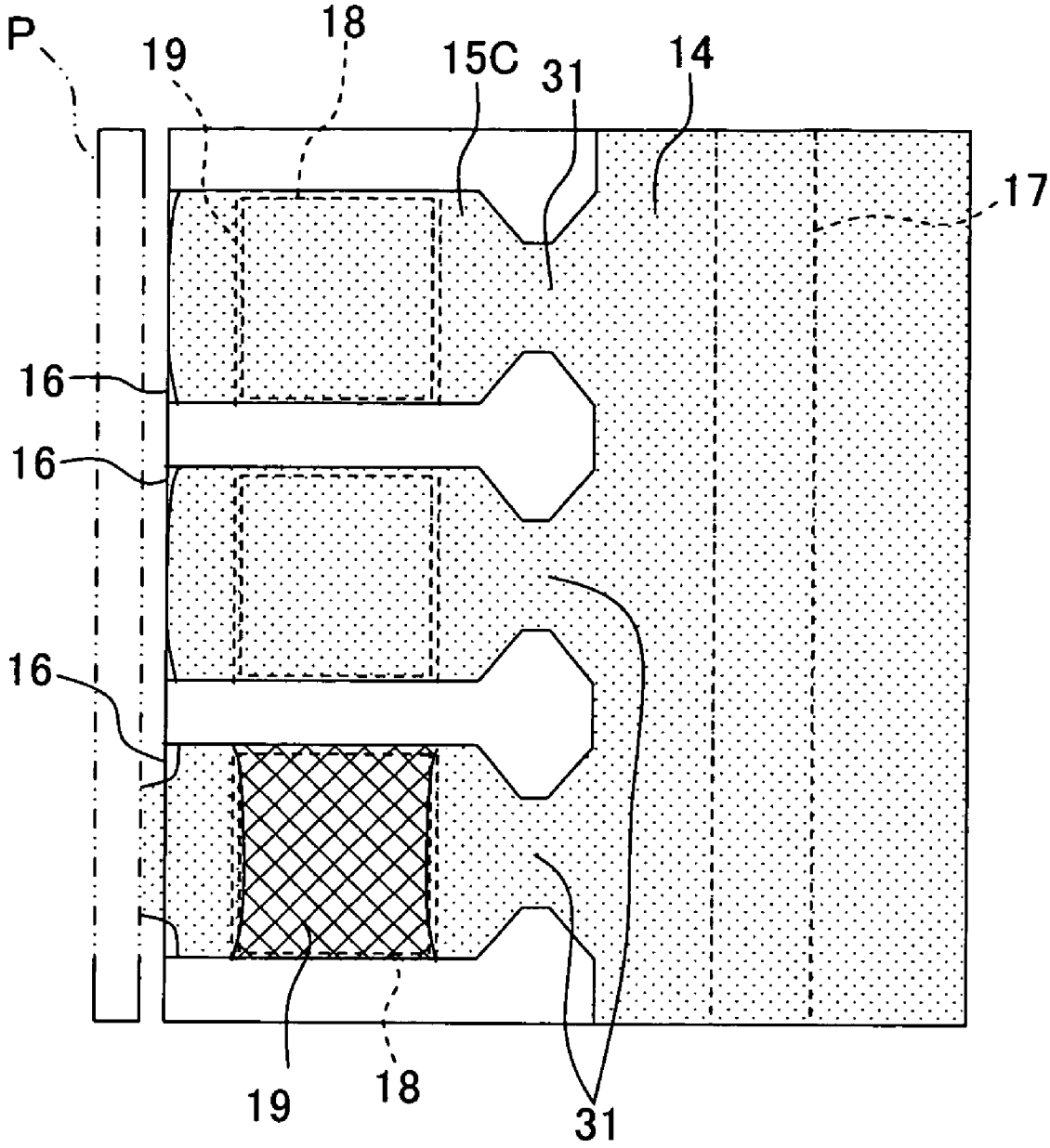
FIG. 10 is a horizontal cross-sectional view of a recording head of a third modification.

As shown in FIG. 10, throttles 31 having a channel area narrowed locally may be formed in communicating portions, respectively, between individual channels 15C and the common channel 14. In this case, the individual electrodes 18 are positioned between the throttles 31 and the discharge sections 16, respectively. Thus, by providing the throttles 31 in the communicating portions between the individual channels 15C and the common channel 14, a channel resistance is increased (becomes substantial) at the communicating portions. Therefore, when the electric potential of the individual electrodes 18 is switched from the first electric potential V to the ground electric potential, an amount in which the ink moves from the surface of the insulating layers 19 toward the downstream side (toward the discharge sections 16) becomes greater than an amount in which the ink moves from the surfaces of the insulating layers 19 to the upstream side (toward the common channel 14). Accordingly, it is possible to discharge the ink in a large amount from the discharge sections 16 in one discharge operation.

Fourth Modification

Figure 11:
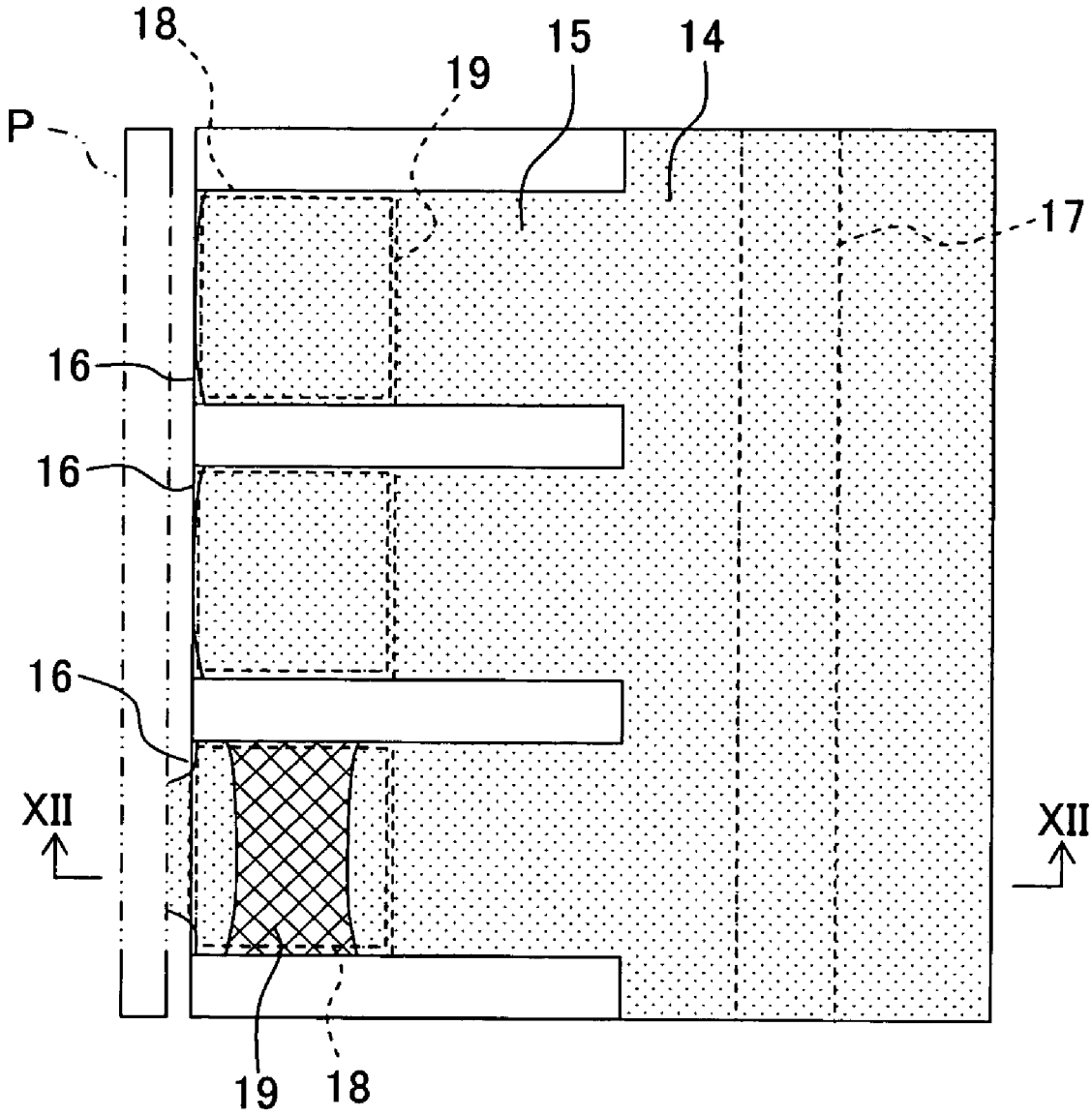
FIG. 11 is a horizontal cross-sectional view of a recording head of a fourth modification.
Figure 12:
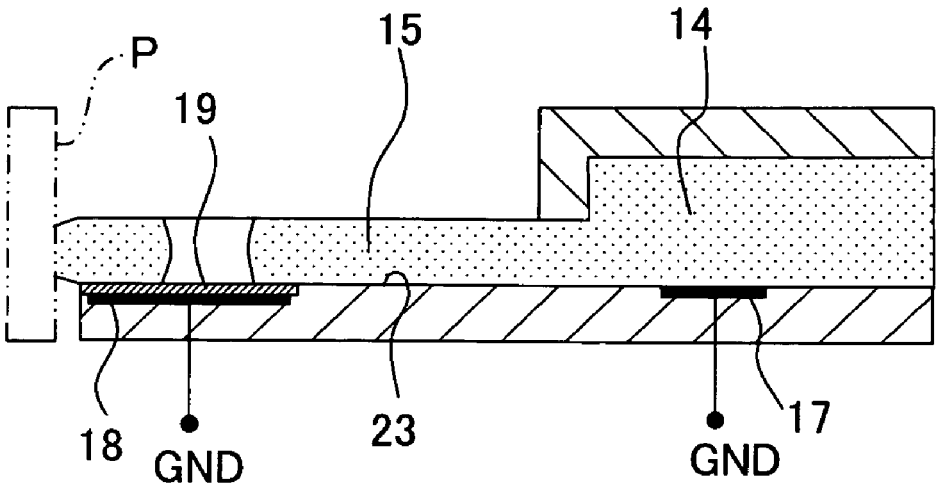
FIG. 12 is a cross-sectional view taken along a line XII-XII shown in FIG. 11.

As shown in FIGS. 11 and 12, each of the individual electrodes 18 and each of the insulating layers 19 may be arranged in an area, of the bottom surface 23, which is continued to (adjacent to) one of the discharge sections 16. According to this structure, it is possible to discharge the ink from the discharge sections 16 assuredly.

Fifth Modification

Figure 13:
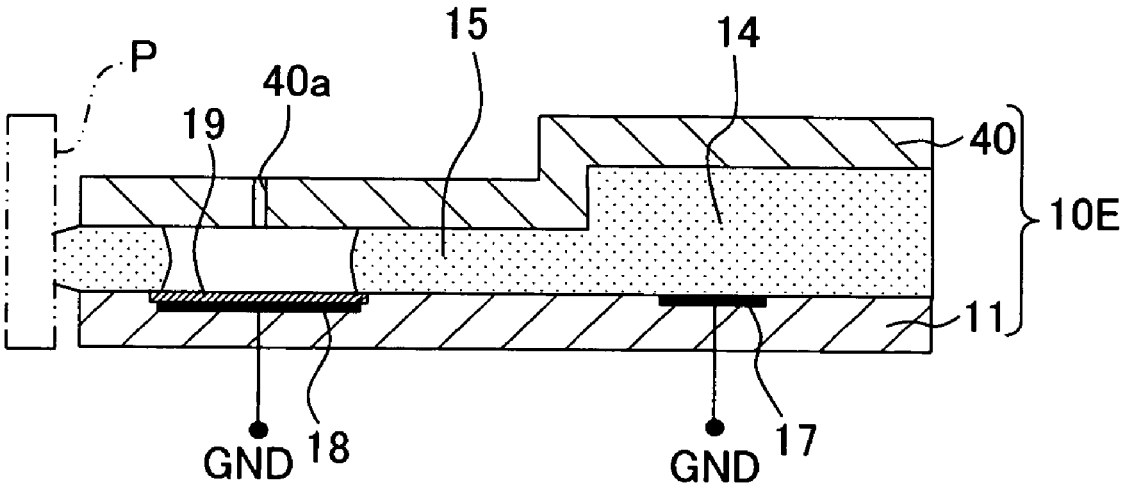
FIG. 13 is a cross-sectional view of a fifth modification, corresponding to FIG. 3.

A head body 10E may be provided with a member which shields the ink in the individual channels 15 from the atmosphere. For example, as shown in FIG. 13, the head body 10E may include a substrate 11, and a cover member 40 which is arranged to cover the upper surface of the substrate 11, wherein the cover member 40 may cover the common channel 14 and the individual channels 15 from above so that the ink is shielded from the atmosphere. In this case, since the ink is covered by the cover member 40, it is possible to suppress the ink from being dried assuredly. An air hole (breathing hole) 40*a* penetrating through the cover member 40 is formed in the cover member 40 at a portion thereof located above each of the individual electrodes 18 and each of the insulating layers 19. Therefore, when the ink moves on the surface of the insulating layer 19, the air can move between the outside of the cover member 40 and each of the individual channels 15 via the air hole 40*a*, thereby making the ink move smoothly on the surface of the insulating layer 19. Here, in order that the ink in each of the individual channels 15 does not enter into the air hole 40*a* due to a capillary force, it is preferable that a wetting angle on an inner surface of the air hole 40*a* is not less than 90 degrees. Specifically, it is allowable that the cover member 40 is formed of a material such as a fluororesin having a high liquid repellent property, or the inner surface of the air hole 40*a* is coated with a material such as a fluororesin having a higher liquid repellent property, by a method such as the chemical vapor deposition (CVD).

Sixth Modification

Figure 14:
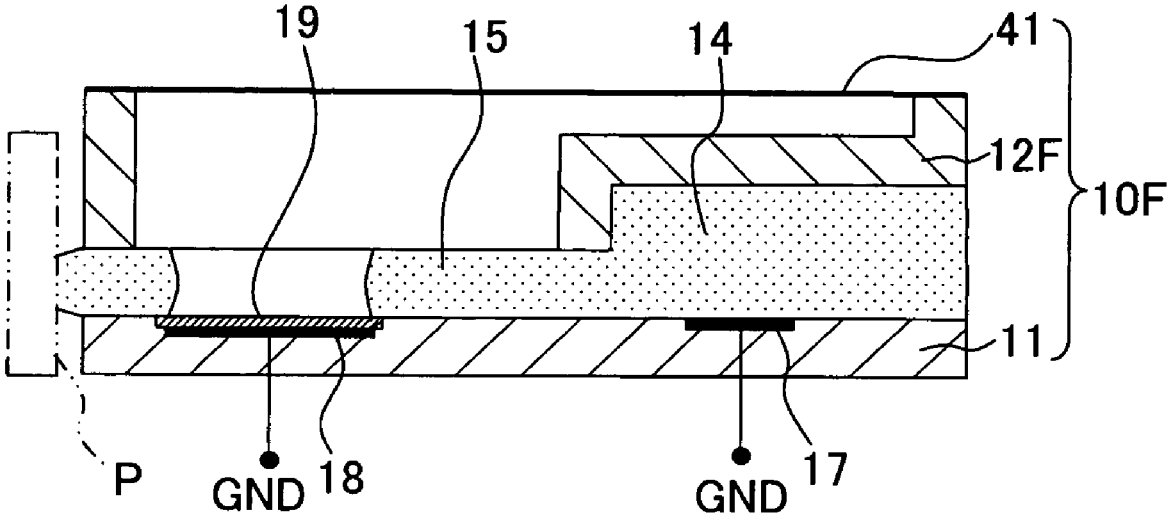
FIG. 14 is a cross-sectional view of a sixth modification, corresponding to FIG. 3.

As shown in FIG. 14, it is allowable that a head body 10F includes a box member 12E, and a cover member 41 which is provided at a position above and away from the ink flowing through individual channels 15, and that a space above the individual channels 15 may be shielded by the cover member 41 from the atmosphere outside the head body 10F. In this case, since there is air between the cover member 41 and the ink in the individual channels 15, there is only a small fluctuation in the pressure generated inside the cover member 41 when the ink is moved on the surface of the insulating layer 19. Accordingly, unlike in the fifth modification (FIG. 13) described above, there is no need to form any air hole in the cover member 41, and it is possible to seal the space above the individual channels 15 completely, thereby further suppressing the drying of the ink. Further, for suppressing the internal-pressure fluctuation in the space, sealed by the cover member 41, to be further smaller, it is preferable to form the cover member 41 with a flexible film member such as polyimide, and that the cover member 41 is capable of absorbing the internal-pressure fluctuation. On the other hand, when a volume of the space sealed by the cover member 41 is large and the internal-pressure fluctuation in the space is sufficiently small, the cover member 41 may be formed by using a material having a high stiffness.

Seventh Modification

Figure 15:
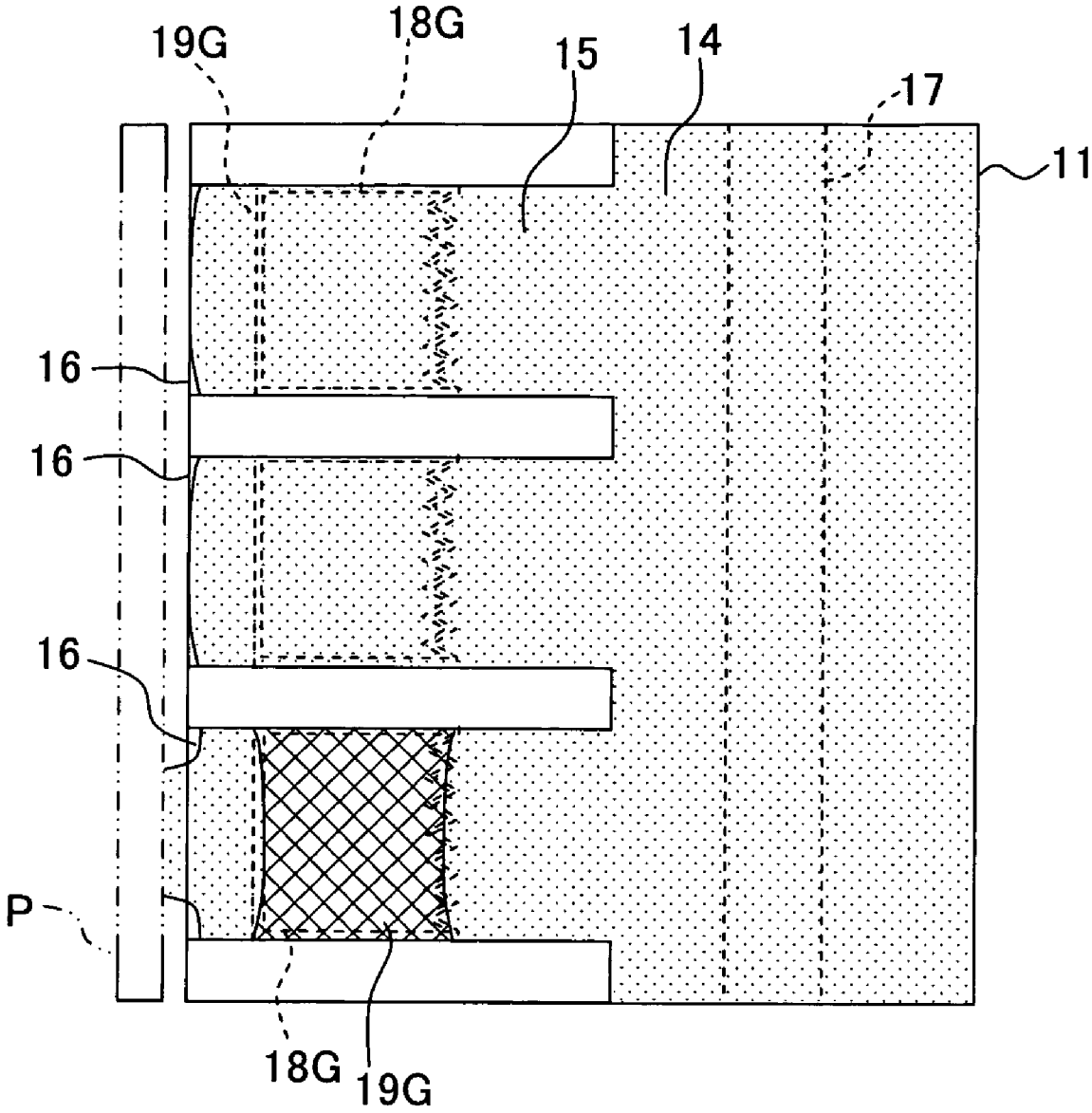
FIG. 15 is a cross-sectional view of a recording head of a seventh modification.

As shown in FIG. 15, in zigzag areas disposed in individual electrodes 18G and insulating layers 19G, respectively, at rear-side portions (portions on the side opposite to the discharge sections 16), a border line of each of the insulating layers 19G may be formed in a zigzag form, in other words, may be formed so that two types of lines having mutually opposite direction of inclination with respect to a width direction of the individual channel 15 are arranged alternately in the width direction. In each of the zigzag areas, an area dimension of the insulating layer 19G is increased progressively toward the frontward portion thereof. In other words, even when a liquid repellent property is different between on surfaces of the insulating layers 19G (coating area) and on an area in which the insulating layer 19G is not provided (non-coating area), the liquid repellent property does not suddenly change on an interface (border) between the coating and non-coating areas. Rather, the liquid repellent property changes gradually with respect to a channel direction (frontward and rearward direction) of the individual channel 15. As a result, the meniscus of the ink in this interface is easily destroyed (meniscus resistance is lowered). Therefore, when the liquid repellent property on the surface of the insulating layer 19G is lowered, the ink can move quickly from the upstream-side portion of the individual channel 15 to the surface of the insulating layer 19G.

Eighth Modification

Figure 16:
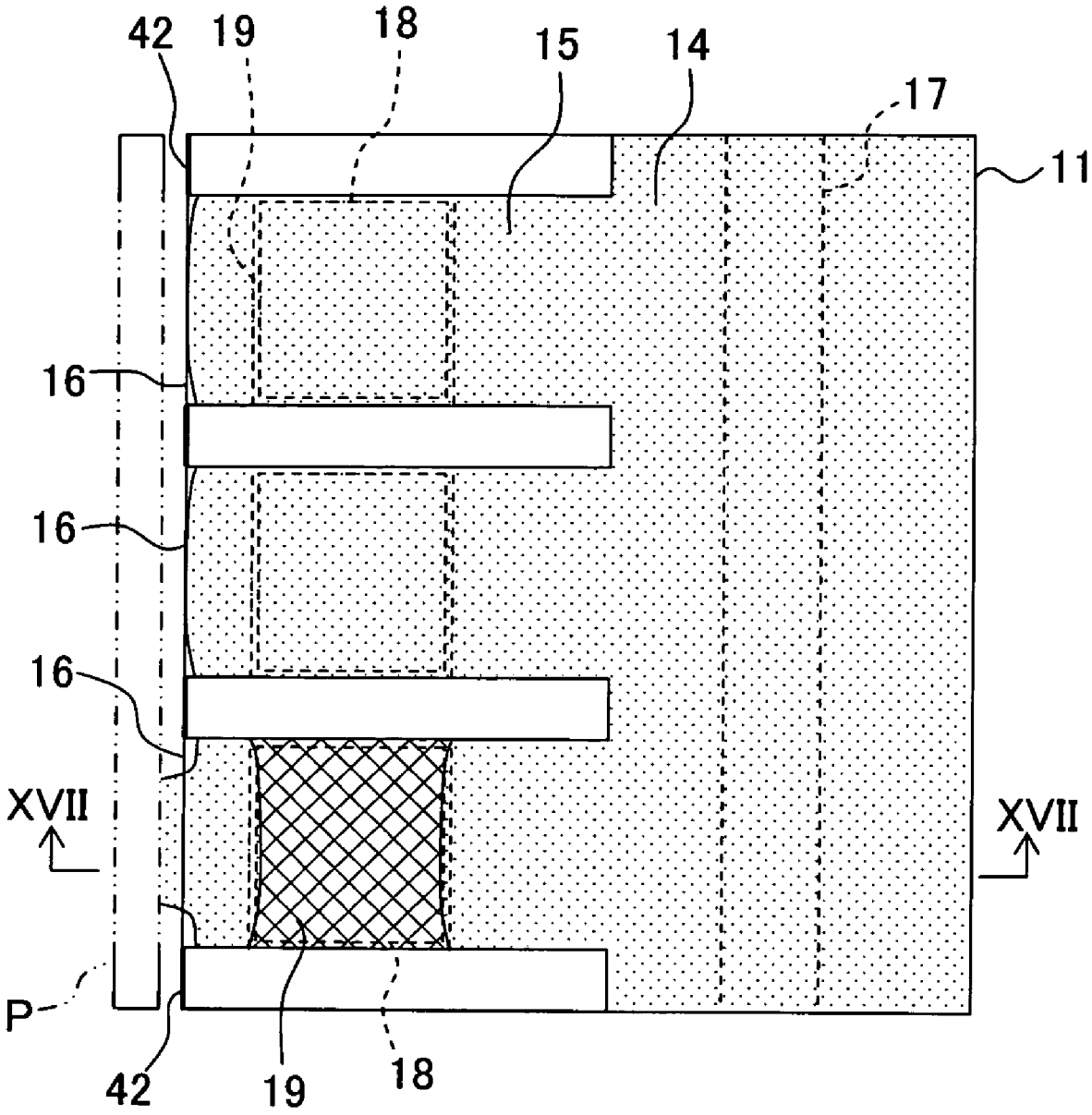
FIG. 16 is a cross-sectional view of a recording head of an eighth modification.
Figure 17:
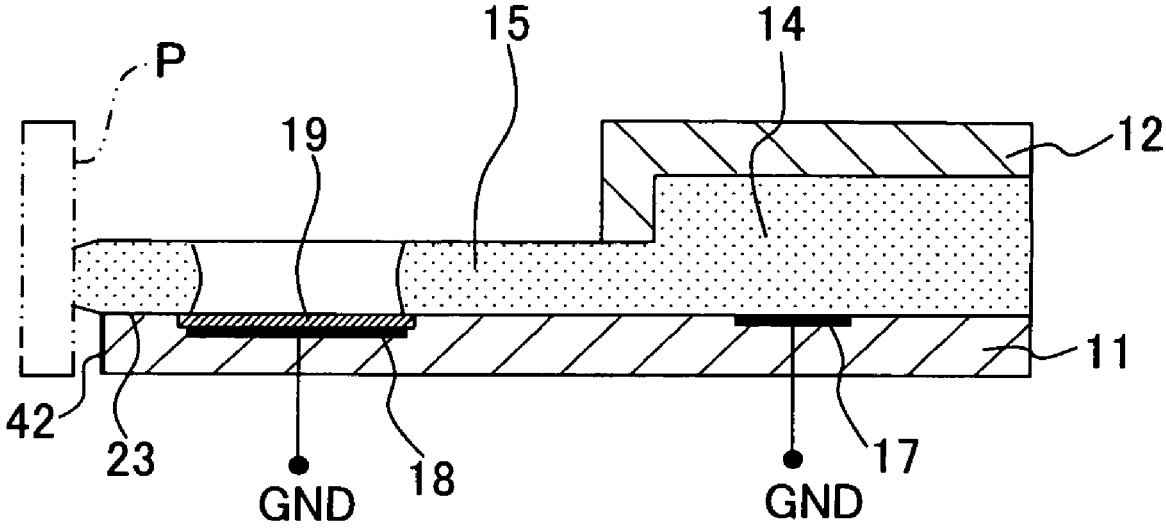
FIG. 17 is a cross-sectional view taken along a line XVII-XVII shown in FIG. 16.

As shown in FIGS. 16 and 17, a liquid repellent film 42 (second liquid repellent area) having a liquid repellent property more than a liquid repellent property on the bottom surface 23, which is the channel-forming surface of the individual channel 15, may be formed at a front end (edge) surface (outer surface), of the substrate 11, continued to the discharge section 16 of each of the individual channels 15. In this case, due to the liquid repellent film 42, the liquid discharged from the discharge section 16 is prevented from adhering to and wetting the front end surface, of the substrate 11, continued to the discharge section 16. Accordingly, the meniscus of the discharge section 16 becomes stable.

Ninth Modification

Figure 18:
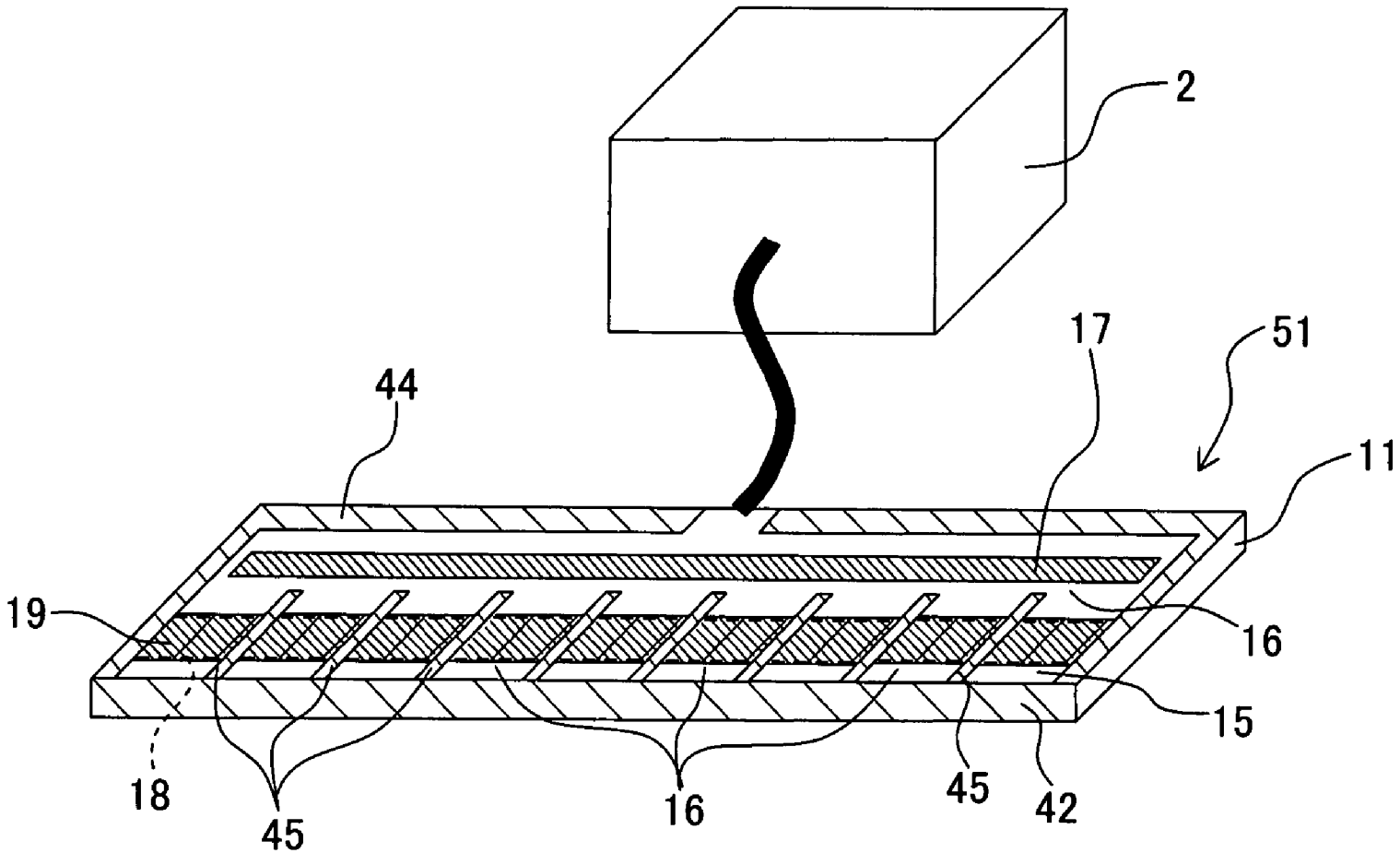
FIG. 18 is a schematic structural view of a printer of a ninth modification.

It is allowable that the individual electrodes 15 are not be partitioned by the partition walls 21 (see FIGS. 1 and 2). Alternatively, the individual electrodes 15 may be partitioned by a liquid repellent film formed on the upper surface of the substrate 11. For example, as shown in FIG. 18, a recording head 5*a* has a substrate 11 of which upper surface is provided with a repellent film 44 formed along left, right, and rear ends of the substrate 11 and a plurality of liquid repellent films 45 formed on the substrate 11 to extend in parallel from the front end toward the rear end of the substrate 11. The liquid repellent property on each of the liquid repellent films 44 and 45 may be almost same as or more than the liquid repellent property on the upper surface of the substrate 11. Further, an area surrounded by the liquid repellent film 44 is the common channel 16, and the individual electrodes 15, each extending frontward from the common channel 16, are partitioned by the liquid repellent films 45. In this case, between two adjacent individual channels 15, among the individual channels 15, the ink does not move crossing across the liquid repellent film 45. Furthermore, since there is no need to provide the partition walls 21 separating the individual channels 15, it is possible arrange the individual channels highly densely. In other words, it is possible to minitualize the recording head. It should be noted that it is preferable to form a liquid repellent film 42, having a higher liquid repellent property similarly as in the eighth modification, on the front end surface, of the substrate 11, continued to the discharge sections 16.

Tenth Modification

In the embodiment described above, the driver IC 20 applies one of the first electric potential V (first electric potential) and the ground electric potential (second electric potential) to the individual electrodes 18. However, it is allowable that the driver IC 20 applies, in addition to these two electric potentials, still another electric potential to the individual electrodes 18.

Further, in the embodiment described above, the common electrode 17 is kept at the ground electric potential all the time. However, the common electrode 17 may be kept at an electric potential other than the ground electric potential. Furthermore, the electric potential of the individual electrode 18 at the time of discharging the ink may be an electric potential other than the ground electric potential. However, the electric potential difference between the ink and the individual electrode 18 when the ink is not discharged is required to be greater than the electric potential difference when the ink is discharged. In other words, the electric potential (third electric potential) of the common electrode 17 is set to an electric potential close to the electric potential (second electric potential) of the individual electrode 18 when the ink is discharged, than to the electric potential (first electric potential) of the individual electrode 18 when the ink is not discharged.

Eleventh Modification

In the embodiment described above, in a state that the first electric potential V is not applied to the individual electrode 18, the liquid repellent property on the surface of the insulating layer 19 is higher than the liquid repellent property on the non-coating area of the upper surface (bottom surface 23) of the substrate 11. However, it is allowable that a coating film made of a insulating (non-electroconductive) material having the liquid repellent property lower than the liquid repellent property of the insulating layer 19 is formed by forming, in the area of the bottom surface 23 in which the insulating layer 19 is not formed, thereby increasing the liquid repellent property on the surface of the insulating layer 19 to be higher than the liquid repellent property on the area, of the bottom surface 23, in which the insulating layer 19 is not formed.

Each of the embodiment and the modifications thereof as explained above is an example in which the present invention is applied to a printer which performs recording by transporting the ink to a recording paper. However, the present invention is also applicable to other liquid transporting apparatuses which transport a liquid other than ink. For example, the present invention is also applicable to an apparatus which forms a wiring pattern by transferring an electroconductive liquid in which metallic nano-particles are dispersed, an apparatus which manufactures DNA chips by using a solution in which DNA is dispersed, an apparatus which manufactures a display panel by using a solution in which an EL (electro luminescence) fluorescent material such as an organic compound is dispersed, an apparatus which manufactures a color filter for liquid crystal display by using a liquid in which pigments for the color filter are dispersed, and the like.

Further, a liquid used in these liquid transporting apparatuses is not limited to an electroconductive liquid, and the liquid may be a liquid obtained by dispersing an electroconductive additive in a non-electro-conductive liquid so as to impart the electro-conductivity to the liquid similarly as an electroconductive liquid.

Furthermore, the present invention is not limited to a liquid transporting apparatus which is capable of discharging a liquid from a plurality of discharge sections, and is applicable also to a liquid transporting apparatus which has one liquid channel provided with one discharge section, and which discharges a liquid only from this one discharge section.

What is claimed is:

1. A liquid transporting apparatus which transports an electroconductive liquid, comprising:

a head including a channel having a channel-forming surface which is insulating and a discharge section from which the liquid is discharged, a working electrode which is arranged on the channel-forming surface, and an insulating layer which is provide on the channel-forming surface to cover the working electrode; and a power supply which supplies an operating voltage between the liquid and the working electrode;

wherein when the operating voltage is not less than a predetermined voltage, the liquid is disposed entirely on the channel-forming surface of the channel, a meniscus of the liquid is formed in the discharge section and the liquid is prevented from being discharged from the discharge section;

wherein, when the operating voltage is less than the predetermined voltage, a part of the liquid, which is on the surface of the insulating layer, is moved toward the discharge section and the part of the liquid is discharged from the discharge section; and wherein, when the operating voltage is less than the predetermined voltage, a liquid repellent property on the surface of the insulating layer is more than a liquid repellent property on a first area, included in the channel-forming surface, in which the insulating layer is absent.

2. The liquid transporting apparatus according to, claim 1;

wherein the power supply selectively supplies a first voltage not less than the predetermined voltage and a second voltage less than the predetermined voltage between the liquid and the working electrode.

3. The liquid transporting apparatus according to claim 2, further comprising:

a pressure applying mechanism which applies, to the liquid in the channel, a pressure exerted toward the discharge section and being lower than a pressure by which the meniscus formed in the discharge section is destroyed.

4. The liquid transporting apparatus according to claim 2, wherein when the power supply supplies the second voltage between the liquid and the working electrode, an electric potential of the working electrode is a ground electric potential.

5. The liquid transporting apparatus according to claim 2;

wherein the channel includes a plurality of liquid channels, and a common channel which commonly communicates with the plurality of liquid channels.

6. The liquid transporting apparatus according to claim 5;

wherein the common channel has a common channel-forming surface which defines the common channel;

wherein a common electrode which is in a direct contact with the liquid in the common channel is formed in the common channel-forming surface; and wherein the power supply maintains an electric potential of the common electrode at a predetermined electric potential.

7. The liquid transporting apparatus according to claim 6;

wherein the predetermined electric potential is a ground electric potential.

8. The liquid transporting apparatus according to claim 5;

wherein each of the liquid channels has a liquid channel-forming surface; and wherein each of the liquid channels is defined by a first liquid repellent area which has a liquid repellent property not less than a liquid repellent property of the liquid channel-forming surface.

9. The liquid transporting apparatus according to claim 2;

wherein a second liquid repellent area which has a liquid repellent property more than that of the channel-forming surface of the channel is formed on a surface, of the head, which is continued to the discharge section and which faces outside the head.

10. The liquid transporting apparatus according to claim 2; wherein a portion of the channel, which is continued to the discharge section, is tapered toward the discharge section.

11. The liquid transporting apparatus according to claim 2; wherein a throttle, in which a channel area is narrowed locally, is provided on the channel at a portion thereof on a side opposite to the discharge section with the working electrode being interposed between the throttle and the discharge section.

12. The liquid transporting apparatus according to claim 2; wherein the working electrode and the insulating layer are arranged in the channel-forming surface at an area thereof continued to the discharge section.

13. The liquid transporting apparatus according to claim 2; wherein the head is provided with a cover member which covers the liquid in the channel to shield the liquid in the channel from an atmosphere outside the head.

14. The liquid transporting apparatus according to claim 13;

wherein an air hole, which communicates the liquid inside the channel with the atmosphere outside the head, is formed in the cover member.

15. The liquid transporting apparatus according to claim 14;

wherein an inner surface of the cover member which defines the air hole is coated by a fluororesin.

16. The liquid transporting apparatus according to claim 2; wherein each of the working electrode and the insulating layer is formed to be zigzag shaped at a portion thereof on a side opposite to the discharge section.

17. The liquid transporting apparatus according to claim 1; wherein the insulating layer is formed of a fluororesin.

18. The liquid transporting apparatus according to claim 1 which is a printer.

* * * * *